US006347210B1

(12) United States Patent
Fotland

(10) Patent No.: US 6,347,210 B1
(45) Date of Patent: Feb. 12, 2002

(54) METHOD AND APPARATUS FOR TRANSFERRING AND FUSING TONER IMAGES

(76) Inventor: Richard Allen Fotland, 1 Crab Apple La., Franklin, MA (US) 02038

( * ) Notice: Subject to any disclaimer, the term of this patent is extended or adjusted under 35 U.S.C. 154(b) by 0 days.

(21) Appl. No.: 09/606,585

(22) Filed: Jun. 29, 2000

Related U.S. Application Data

(60) Provisional application No. 60/142,402, filed on Jul. 6, 1999.

(51) Int. Cl.[7] ..... G03G 15/16
(52) U.S. Cl. ..... 399/307
(58) Field of Search ..... 399/307, 318

(56) References Cited

U.S. PATENT DOCUMENTS 4,365,549 A 12/1982 Fotland et al.
4,448,872 A * 5/1984 Vandervalk ..... 399/318 X
4,455,079 A * 6/1984 Miwa et al. ..... 399/318 X
4,542,978 A * 9/1985 Tarumi et al. ..... 399/318 X
4,894,687 A 1/1990 Beaudet

FOREIGN PATENT DOCUMENTS

GB 1271606 4/1972

* cited by examiner

*Primary Examiner*—Fred L Braun

(57) ABSTRACT

An apparatus for simultaneously transferring an image from an imaging drum to a receptor surface in a nip formed between the imaging drum and a transfer roll using shear strain between the imaging drum and receptor sheet to provide high transfer efficiency. The improvement involves clamping the receptor sheet to the transfer roll so that all of the shear strain appears between the imaging drum and the receptor surface. Clamping may be effected by roughening the transfer roll surface, cutting fine grooves in the transfer roll surface, or providing a third or pressure roll to form a second higher pressure nip between the transfer roll and the pressure roll. The combination of high friction in the second nip and the imaging surface wrap around the pressure roll effectively cause the imaging surface to accurately track the motion of the transfer roll.

5 Claims, 4 Drawing Sheets

METHOD AND APPARATUS FOR TRANSFERRING AND FUSING TONER IMAGES

This Appln claims benefit of Prov. Ser. No. 60/142,402 filed Jul. 1, 1999.

BACKGROUND OF THE INVENTION

The present invention relates to electrostatic printing apparatus, and more particularly to method and apparatus for transferring and fusing toned electrostatic images to plain paper or other receptor substrates.

Electrostatic imaging processes initially require the formation of a latent electrostatic image, typically by electrographic or electrophotographic means, on a dielectric member. The latent electrostatic image is subsequently toned, and the toned image may be transferred to a further member. In the usual case, the toned image is transferred to plain paper. The transferred image is usually subsequently fused or fixed to the receptor medium, to provide enhanced durability and permanence.

Various toner image transfer methods are known in the prior art. The transfer may be accomplished electrostatically, by means of a charge of opposite polarity to the charge on the toner particles, the former charge being used to draw the toner particles off the dielectric member and onto the image receptor.

Alternatively, the image receptor medium may be passed between the toned member and a transfer member, and the toner image transferred by means of pressure at the point of contact. Usually, the toner image is fused to the image receptor subsequently to transfer of the image, at a further process station. Post transfer fusing may be accomplished by pressure, radiation, or hot roll.

It is possible, however, to accomplish transfer and fusing of the image simultaneously. This may be accomplished by a heated roller or simply by means of high pressure between the image-bearing dielectric member and a transfer member, between which the image receptor passes. Apparatus utilizing high pressure for simultaneous transfer/fusing is disclosed in Fotland and Carrish, U.S. Pat. No. 4,365,549 (Dec. 28, 1982).

A problem that is typically encountered in transferring a toner image solely by means of pressure is the existence of a residual toner image on the dielectric member after image transfer, due to inefficiencies in toner transfer. These residual toner particles require scraper blades or other removal means, and can eventually accumulate at the various process stations associated with the dielectric member, including the apparatus for forming the latent electrostatic image. These toner accumulations decrease the reliability of the apparatus, necessitating service at intervals. Furthermore, such inefficiencies in toner transfer may lead to mottling of the images formed on the image receptor sheets.

Shepard and Meldurm, British Patent No. 1,271,606 (Apr. 19, 1972) disclose apparatus for transferring a toner image onto an image receptor, involving an imaging roller and a pressure roller arranged to be normally in contact under high pressure. Various embodiments are disclosed for achieving a slippage between the surface of the imaging roller (from which the toner image is transferred) and the image receptor. These include covering the pressure roller with an elastic material, and driving the rollers to achieve a peripheral speed differential. The apparatus is said to achieve lower transfer pressure requirements and provide higher toner transfer efficiency.

Beaudet, U.S. Pat. No. 4,894,687 (Jan. 16, 1990) teaches the use of skewed rollers to improve the efficiency of toner transfer. As a receptor web moves through a skewed nip, the web moves with lateral slip thus generating a shearing strain at the web-toner interface. This shear, along with relative paper-image roll motion, increases the transfer efficiency of the system.

Skewing of the rollers, however, leads to significant problems relating to web handling. A transverse force is imparted to a paper web passing through the nip formed by skewed rollers. The web tends to move to the higher paper web tension side of the pressure roll assembly. Unless very high web tension is employed, this can result in wrinkling of the web. It is very difficult to control the lateral position of the web. This lack of control results in color registration problems in multi-station printer systems.

The transferred image is skewed. A rectangle, for example, printed on the imaging roller appears as a parallelogram after transfer. The printed image must, therefore, be printed in a reverse skew to compensate the transfer skew.

The motion of the paper through the pressure nip is controlled by the relative coefficients of friction between the paper/image roll and the paper/transfer roll. The coefficient of friction between the paper and image roll varies with time due to the presence of toner between the image roll surface and paper. In general, the presence of toner reduces the apparent coefficient of friction between paper and image roll. This results in a lateral displacement of the web between as the toned area on the image roll varies.

SUMMARY OF THE INVENTION

Accordingly, it is an objective of the invention to provide improved electrostatic imaging apparatus for pressure transfer of a toner image from a dielectric surface to a receptor sheet that overcomes limitations associated with web tracking errors. A related object of the invention is to provide a transfer method which effects simultaneous fusing of the toner image.

Another objective of the present invention is the reduction in the skew requirement to obtain high efficiency of toner transfer.

Another objective of the invention is simultaneous pressure transfer/fusing characterized by a high efficiency of toner transfer.

A further objective is to provide a method and apparatus that minimizes paper distortion and wrinkling under high nip pressures.

Another objective of the invention is to provide a constant paper motion thus simplifying multi-stage image registration.

It is a further objective of the invention to minimize the amount of residual toner on the dielectric image member after transfer/fusing. Related objects are increased reliability of electrostatic imaging apparatus, and decreased service requirements.

A further, related objective of the invention is to provide apparatus that allows the creation of high quality toned images at high speeds.

In furthering the above and additional objectives, the invention provides method and apparatus for simultaneously transferring an image from an imaging roll to a receptor surface in a nip formed between the imaging roll and a transfer roll using shear strain between the imaging roll and receptor sheet to provide high transfer efficiency. The improvement involves clamping the receptor sheet to the transfer roll so that all of the shear strain appears between the imaging roll and the receptor surface. Clamping may be effected by providing a third pressure roll to form a second nip between the transfer roll and the pressure roll. The combination of high friction in the second nip and the imaging surface wrap around the pressure roll effectively cause the imaging surface to accurately track the motion of the transfer roll.

High transfer efficiency is provided by either the presence of skew between the image and transfer roll, as in the case of U.S. Pat. No. 4,894,687, or through the use of differential speed as described in British Patent No. 1,271,606.

DESCRIPTION OF THE DRAWINGS AND PREFERRED EMBODIMENTS

Figure 1:
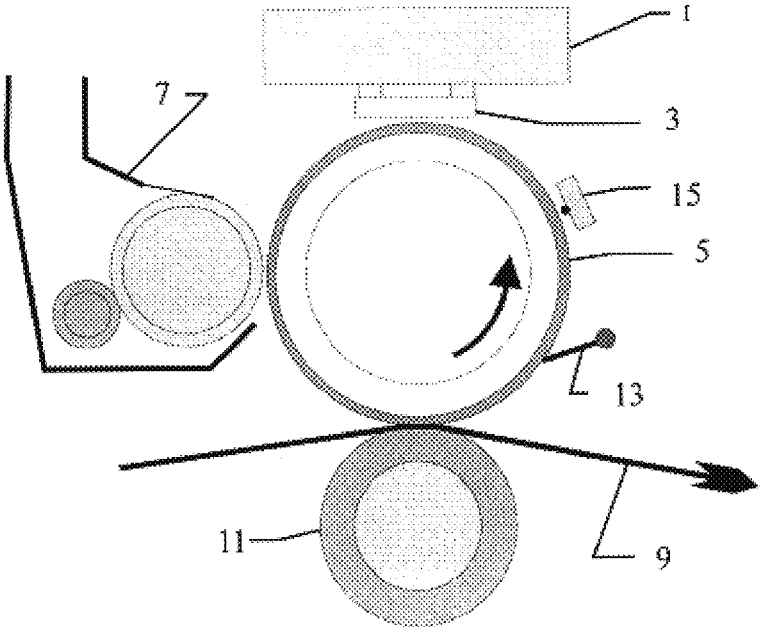
FIG.1 (PRIOR ART)
FIG. 1 is a schematic side view of a prior art printer employing a simultaneous transfer and fusing feature.

FIG. 1 schematically illustrates a prior art device for simultaneously transferring and fusing toned images. A charge emitting print head 3, driven by drive circuits 1 provides an electrostatic latent image on the dielectric surface of imaging drum 5. The latent image is toned using development station 7 and the toned image transferred to receptor web 9 in the nip formed between image roll 5 and pressure roll 11. Scraper blade 13 and ac corona erase unit 15 recondition the dielectric surface of image roll 5 by removing residual toner and discharging any residual electrostatic latent image. High efficiency toner transfer is obtained by the use of differential surface speed between image roll 5 and pressure roll 11 as described in British Pat. 1,271,606. Alternately, high transfer efficiency is realized by relative motion between receptor web 9 and image roll 5 caused by arranging the rolls in a skewed relationship as described in U.S. Pat. No. 4,894,687.

Figure 3:
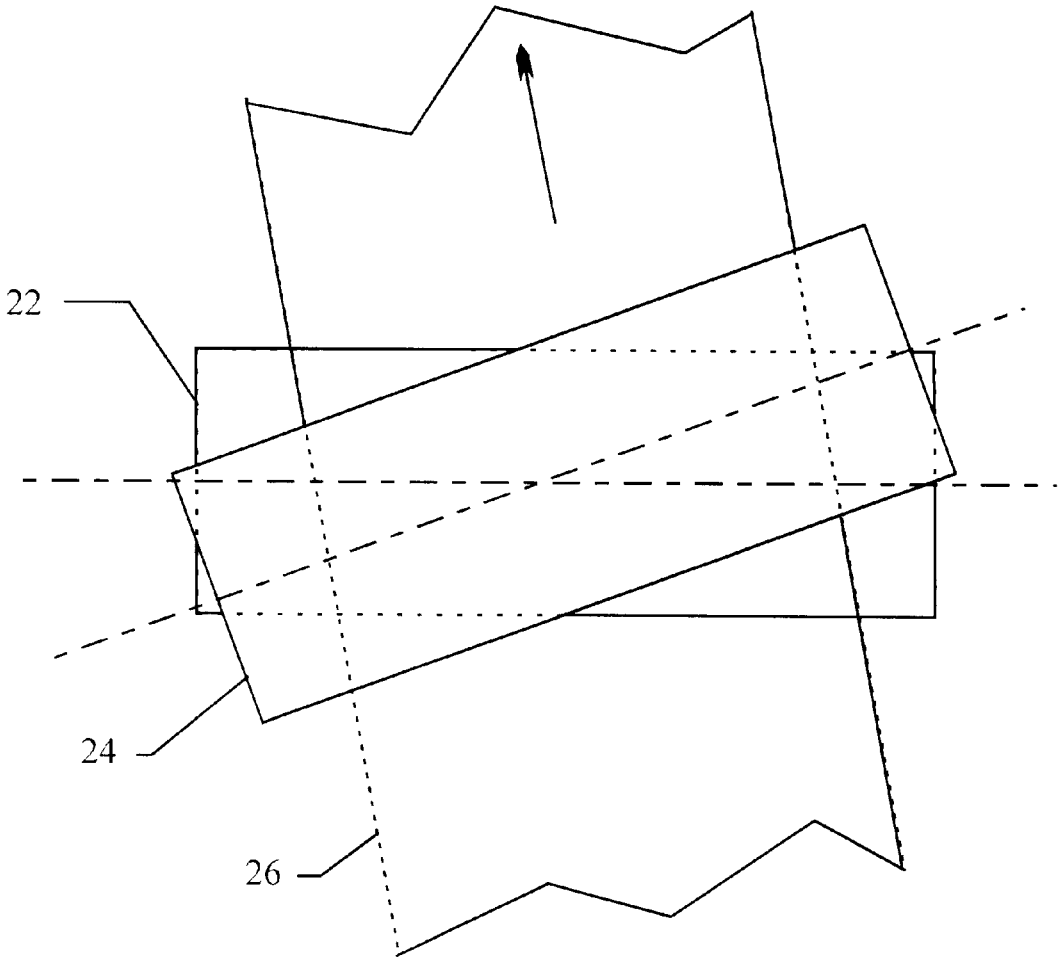
FIG. 3 (PRIOR ART)
FIG. 3 shows the geometric configuration of the web passing through the transfer pressure nip in the prior art printer shown schematically in FIG. 1.

The prior art skew configuration is shown in FIG. 3, a top schematic view showing the relationships between image roll 24, receptor web 26, and transfer roll 22. Web 26 is skewed to both image roll 24 and pressure roll 22. The actual value of the web skew depends, as previously mentioned, upon the relative coefficients of friction and thus upon the amount of toner on image roll 24. The skew between the rollers must be equal to about twice the desired skew between image roll 24 and receptor web 26. Thus, if a web-image roll skew of ¼ degree is desired, the apparatus must be designed with a roller skew of ½ degree.

Figure 2:
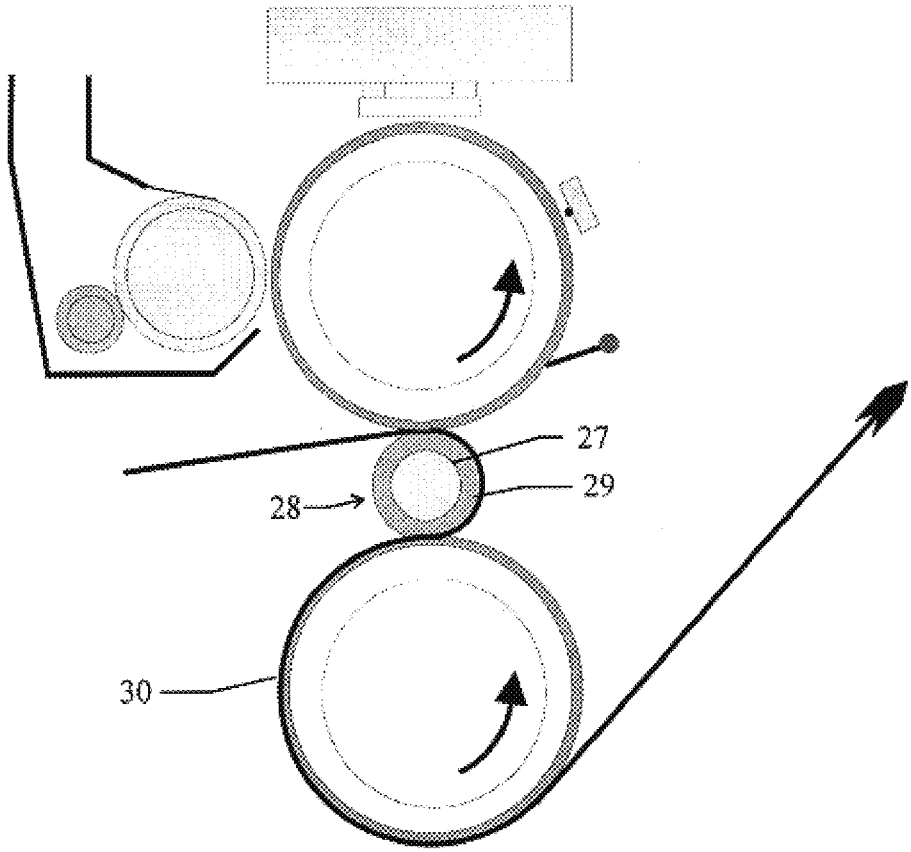
FIG. 2 is a schematic side view of a printer employing the three roll transfer apparatus of the present invention.

The present invention provides a second receptor web nip for the purpose of stabilizing lateral web motion. FIG. 2 illustrates major features of the invention. The image roll and image forming, developing, and image roll surface reconditioning features are as in prior art illustrated in FIG. 1. The present invention adds a second nip formed between transfer roll 28 and pressure roll 30. The axis of rolls 28 and 30 are parallel. Shear between the toner and receptor web in the transfer nip is provided either by skew maintained between the image and the transfer roll or, alternately, by providing a differential surface speed between image roll and transfer roll. The receptor web is locked to the pressure roll surface because of the high wrap around both the transfer and the pressure rolls and the high frictional forces formed in the nip between transfer roll 28 and pressure roll 30.

In a preferred embodiment of the invention, the image roller has a hard, smooth dielectric surface. Best results obtained where the surface has a surface finish better than 20 microinch RMS, and a modulus of elasticity on the order of $10^7$ PSI. The transfer roller preferably includes a relatively hard surface. Advantageously, the transfer roller 28 consists of metal core 27 having sleeve 29 comprised of a stress-absorbing engineering thermoplastic or thermoset material, having a modulus of elasticity on the order of 100,000–700,000 PSI. Pressure roll 30 may be fabricated using the same materials as transfer roll 28. The transfer roll diameter may be made smaller than either the image or pressure roll diameter. Higher peak pressures may be developed using lower applied forces. In the case of the skewed system, the large diameter of the pressure roll will eliminate any roll beam deflection problems associated with the small diameter of the transfer roll.

Figure 4:
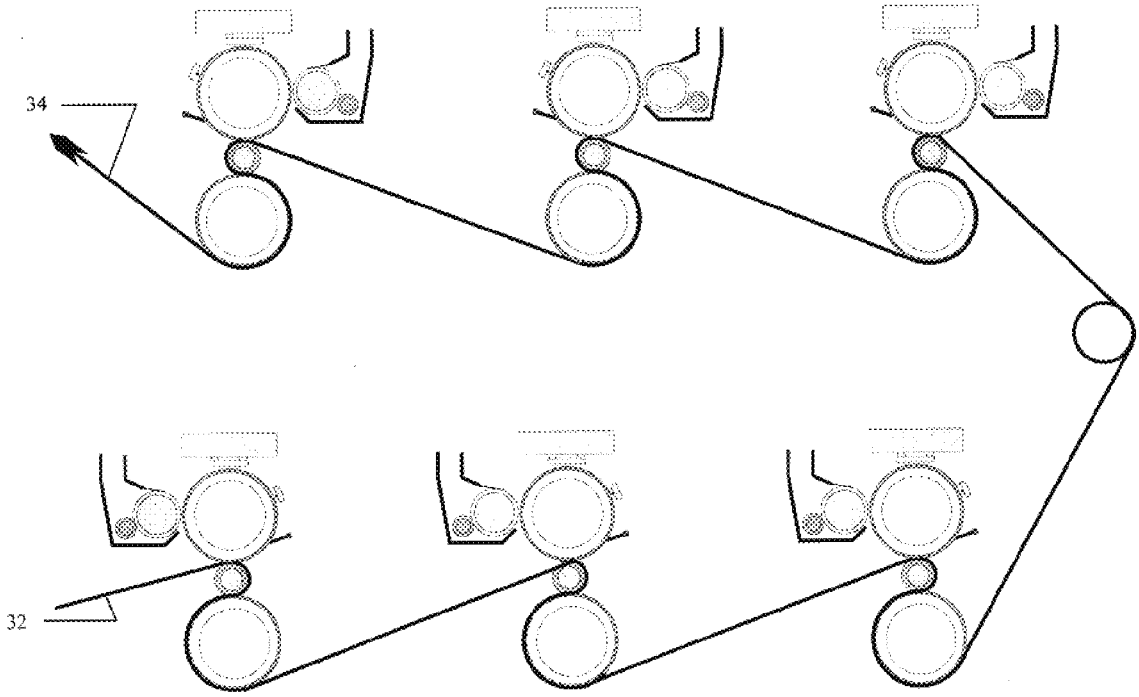
FIG. 4 is a schematic of a six-station color printer using the apparatus of the present invention.

FIG. 4 is a schematic drawing showing how six engines may be configured for three-color duplex printing. Here, a receptor web is shown at location 32 entering the lower array of three engines, each of which prints a different color image onto one surface of the web. The web is turned and then printed with three different colored images. The duplex printed web exits the printer at position 34.

Figure 5A:
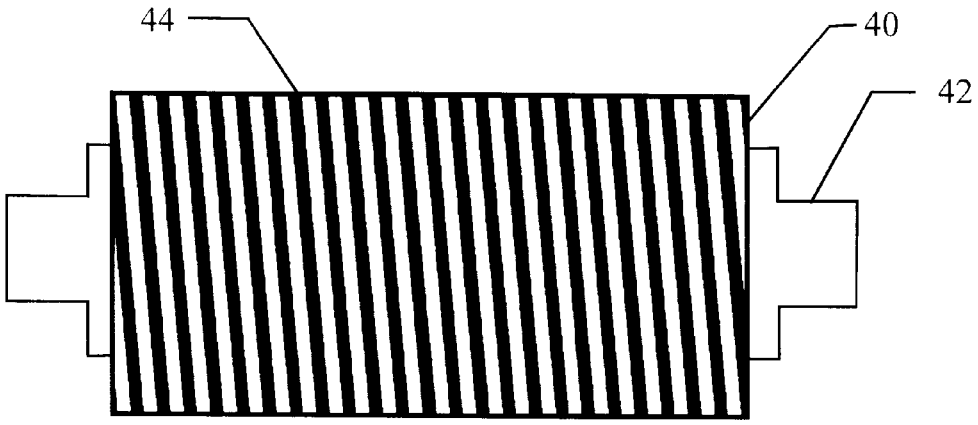
FIGS. 5A, 5B and 5C illustrate surface textured transfer rolls.
Figure 5B:
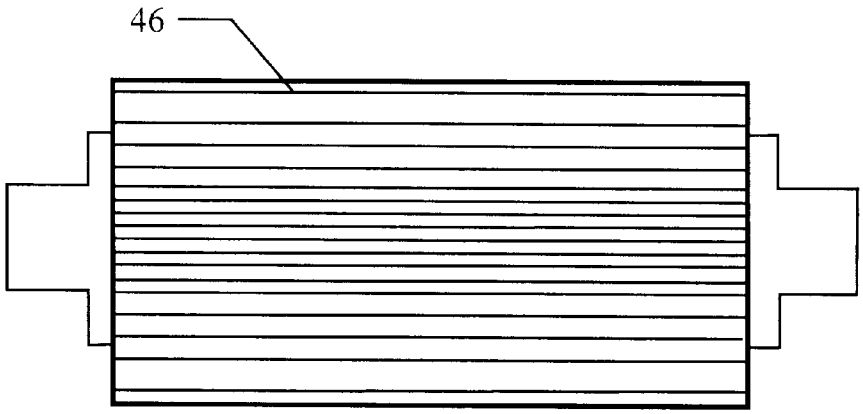
Figure 5C:
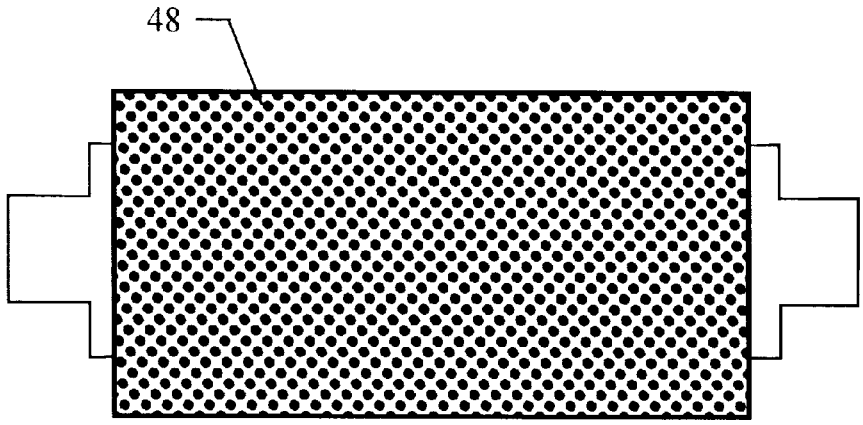

Lateral displacement of the paper web may be eliminated or greatly reduced by treating surface of transfer 28 to provide a high level of friction between the transfer roll and web 9. In FIGS. 5A, 5B, and 5C, metal core 42 is provided with textured sleeve 40. The high friction may be maintained by providing the transfer roll surface with rough surface 48, shown schematically in FIG. 5C so that a "tooth" is formed to grip the imaging surface. Alternately, a series of very fine grooves may be formed in the surface of the transfer roll. For transfer under shear, grooves 48 run circumferentially. In the case of differential surface speed or slip, grooves 46 run in the direction of the transfer roll axis.

What is claimed is:

1. An apparatus for transferring substantially all of a toned image from a first cylindrical surface to the surface of an image receptor moving through a first pressure nip that comprises a pressure nip formed by a first cylinder and a second cylinder where the axis of said first cylinder and said second cylinder are skewed with respect to each other and a second high pressure nip for clamping the image receptor between said second cylinder and a third cylinder opposed and parallel to said second cylinder whereby lateral motion of said image receptor with respect to said second cylinder is eliminated.

2. The apparatus of claim 1 where said second cylinder has a spirally grooved surface whereby the lateral friction forces between said first cylinder and said image receptor are less than the lateral friction forces between said second cylinder and said image receptor.

3. An apparatus for transferring substantially all of a toned image from a first cylindrical surface to the surface of an image receptor in a first pressure nip formed by said first cylinder and a second cylinder while maintaining a controlled slip between said image receptor and said first cylinder while said image receptor is constrained to follow the surface of said second cylinder by a second high pressure nip formed between said second cylinder and a third cylinder.

4. The apparatus of claim 3 where said second cylinder has a roughened surface whereby the friction forces between said first cylinder and said image receptor are lower than the friction forces between said second cylinder and said image receptor.

5. The apparatus of claim 3 where said second cylinder has a transversely grooved surface whereby the friction forces between said first cylinder and said image receptor are lower than the friction forces between said second cylinder and said image receptor.

* * * * *